United States Patent [19]

Dolence

[11] 4,424,759

[45] Jan. 10, 1984

[54] SAILBOARD GOOSENECK

[75] Inventor: Dale M. Dolence, Milwaukee, Wis.

[73] Assignee: Neodyne Corporation, Waukesha, Wis.

[21] Appl. No.: 492,915

[22] Filed: May 9, 1983

[51] Int. Cl.[3] ..... B63H 9/10

[52] U.S. Cl. ..... 114/97; 114/98

[58] Field of Search ..... 114/39, 89, 90, 97, 114/98, 99

[56] References Cited

FOREIGN PATENT DOCUMENTS

| | | | |
|---|---|---|---|
| 2912867 | 3/1979 | Fed. Rep. of Germany | 114/98 |
| 3030077 | 8/1980 | Fed. Rep. of Germany | 114/97 |
| 616374 | 3/1980 | Switzerland | 114/99 |

*Primary Examiner*—Trygve M. Blix
*Assistant Examiner*—Patrick W. Young
*Attorney, Agent, or Firm*—Henry C. Fuller

[57] ABSTRACT

A gooseneck for rigidly but detachably attaching the boom of a sail-powered vehicle to the mast. The gooseneck includes a mast collar which in the unassembled condition is freely slideable over the mast. A boom yoke receives the forward ends of the boom spars. The yoke is vertically rotatable about a fulcrum provided in the mast collar. Co-operating surfaces in the collar and boom yoke lock the yoke to the collar and circumferentially compress the collar onto the mast as the boom is lowered to a horizontal attitude, thus firmly locking the mast collar, and the boom yoke carried thereby, to the mast.

15 Claims, 4 Drawing Figures

SAILBOARD GOOSENECK

BACKGROUND OF THE INVENTION

1. Field of the Invention

This invention pertains to wind-powered vehicles, and more particularly to apparatus for attaching the boom and mast of a wind-powered vehicle.

2. Description of the Prior Art

U.S. Pat. No. 3,487,800 discloses a basic wind-powered sailboard consisting essentially of a hull, a mast, a sail, and a wishbone shaped boom. The boom of a sailboard normally consists of two spars, one on either side of the sail. In the typical sailboard, it is considered desirable to attach the boom to the mast in a manner that allows the mast and boom to pivot as a unit with respect to the hull about a generally vertical axis. The attachment mechanism is frequently referred to as a gooseneck.

Various sailboard goosenecks have been developed. For example, U.S. Pat. Nos. 3,487,800; 4,319,536; and 4,334,488 disclose devices that utilize ropes or tapes to connect the mast and boom. The use of ropes or tapes as attaching means presents several drawbacks. These include the tendency of the ropes or tapes to yield under the forces imposed by the wind, difficulty in loosening them when wet, and frequently the requirements of expert knot tying abilities by the user. The ropes often loosen under use. British Pat. No. 1,551,426 shows a boom which includes an eye for enabling the boom to be connected to the mast. That design does not allow unitary pivotal motion of the boom and mast and therefore is not completely satisfactory. International Pat. No. WO79/01078 illustrates three variations of mast-boom attachment devices. Each of the devices is somewhat deficient in that each requires the manipulation of small components, which may be easily damaged or lost. Further, the number of pieces required by the various designs represent undesirable expense and complexity.

Accordingly, a need exists for apparatus to attach the boom of a wind-powered vehicle to the mast in a manner that enables unitary pivoting of the mast and boom and that is inexpensive, simple, and convenient to use.

SUMMARY OF THE INVENTION

In accordance with the present invention, there is provided a simple but effective gooseneck for attaching the boom of a wind-powered vehicle to the mast. The attachment apparatus rigidly links the boom and mast in a predetermined vertical plane that is pivotable about the mast longitudinal axis. The gooseneck allows rapid attachment and removal of the boom from the mast, infinite positioning of the boom height on the mast, and secure attachment between the boom and the mast. In the preferred embodiment, the invention includes a cooperating mast collar and boom yoke. The mast collar is adapted to fit slideably over the mast as to be easily positioned to the desired location on the mast. The collar is generally tubular in shape, and it is formed with a pair of identical bosses which protrude outwardly from opposite sides. Each boss includes a substantially flat laterally facing surface bounded on one side by a generally arcuate external shoulder. The flat laterally facing boss surfaces taper convergently upward with respect to the mast. The mast collar further includes a horizontally disposed fulcrum member, such as a slot, incorporated into the tubular member periphery midway between the bosses. The tubular member is preferably formed with at least a partial longitudinal slit. The slit may be diametrically opposite the fulcrum.

The boom yoke includes a pair of receptacles for receiving the forward ends of the boom spars. If the boom is wishbone shaped, the receptacles diverge toward the stern. The forward ends of the receptacles are rigidly joined by a horizontal gusset which may include a round pin-like component. The inwardly facing external periphery of each boom receiving receptacle is formed with a flat surface. The two flat surfaces converge upwardly, and they are adapted to correspond with the boss flat surfaces of the mast collar. A tab extends inwardly from the after side of each yoke flat surface. The tabs may be constructed with at least partially arcuate surfaces that correspond to the arcuate shoulders on the mast collar bosses. The forward ends of the two boom receiving receptacles may also be connected by a generally C-shaped member to create a convenient carrying handle. If desired, the boom yoke may be permanently fastened to the boom spars.

The present invention is also concerned with ease of attaching and removing the gooseneck from the sail-powered vehicle. Assembly is accomplished in the present instance by merely slipping the mast collar over the mast to the desired location. The boom, including the boom yoke, is also brought over the mast. The boom after end is tilted upwardly. The circular pin of the boom yoke is inserted into the slot of the mast collar. With the pin and slot in engagement, a simple lowering of the boom engages the arcuate surfaces of the yoke tabs with the arcuate shoulders of the collar bosses. Simultaneously, the tapered flat surfaces of the yoke abut the tapered flat surfaces of the collar. Continued lowering of the boom results in a wedging action between the collar and yoke, thus compressing the collar tightly onto the mast. The gooseneck fitting is fully locked when the boom is in a generally horizontal attitude. The boom is prevented from falling below horizontal by the maximum compressive deformation of the tubular collar of the mast and the sail outhaul. To relocate or remove the boom, merely raising it removes the wedging force and unlocks the collar from the mast. During sailing operation, the boom is prevented from rising by an outhaul connected between the after end of the boom and the clew of the sail.

Other objects and advantages of the invention will become apparent from the disclosure.

DETAILED DESCRIPTION OF THE INVENTION

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
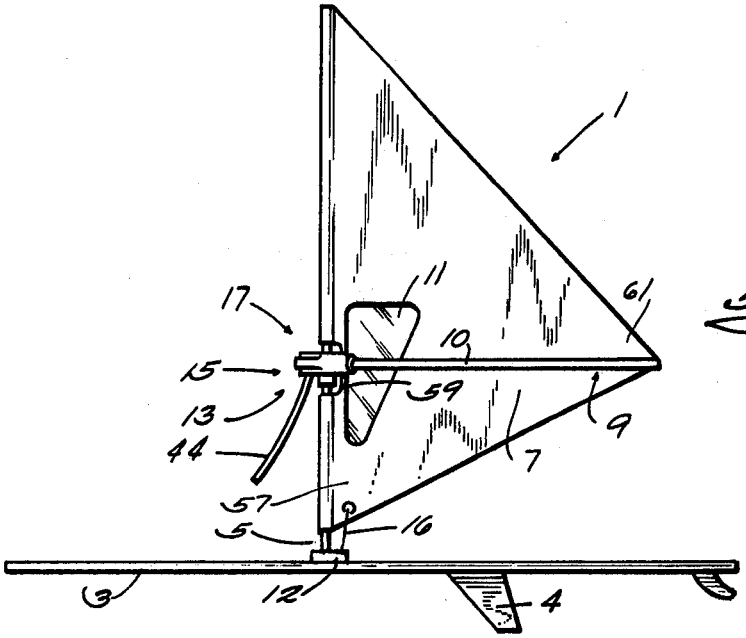
FIG. 1 is a side view of a sailboard that incorporates the gooseneck of the present invention.
Figure 3:
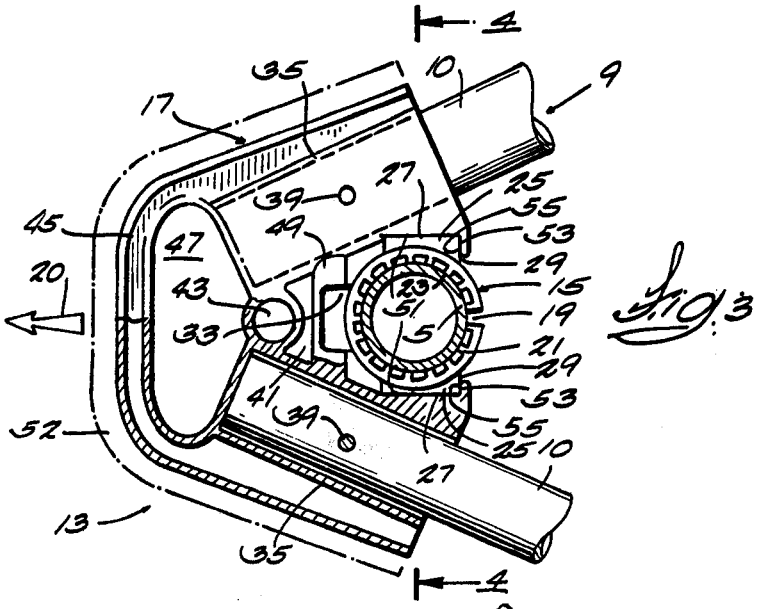
FIG. 3 is a top view, partially in cross-section, of the gooseneck of the present invention.

Referring to FIG. 1, reference numeral 1 indicates a sailboard that is representative of wind-powered vehicles with which the present invention finds particular usefulness. The sailboard includes a hull 3, a mast 5, a sail 7, a boom 9, and a daggerboard 4. The boom 9 is normally composed of two spars 10, as shown in FIG. 3. The sail 7 may contain a window 11. The mast 5 is pivotable with respect to the hull about a generally transverse axis by a universal joint 12. A conventional outhaul, not shown, is employed. A downhall 16 connects the tack of the sail to the universal 12.

In accordance with the present invention, a gooseneck 13 is provided to rigidly attach the boom 9 to the mast 5 so that the boom and mast pivot as a unit. This is accomplished in the present instance by fabricating the gooseneck 13 as two interlocking but freely separable components, a mast collar 15 and a boom yoke 17.

Figure 2:
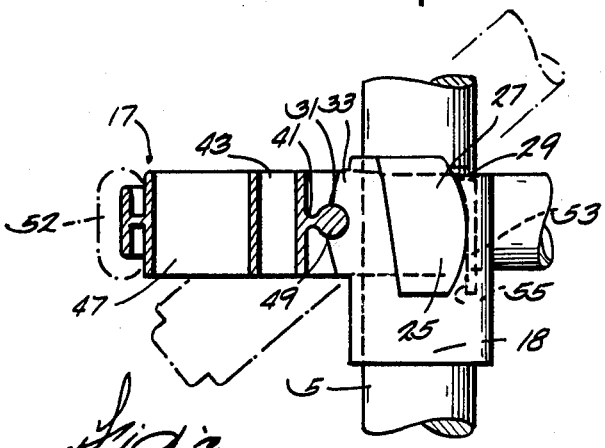
FIG. 2 is a side view, partially in cross-section, of the gooseneck of the present invention, with the unlocked position of the gooseneck being shown in phantom.
Figure 4:
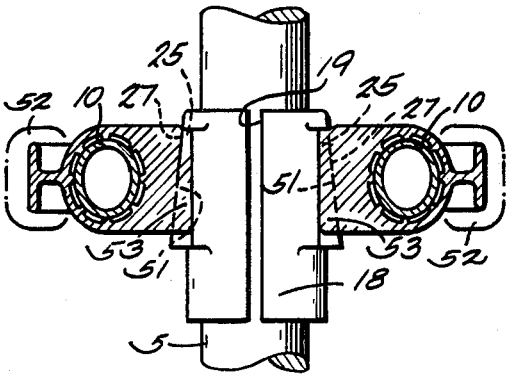
FIG. 4 is a sectional view taken along lines 4—4 of FIG. 3.

In the preferred embodiment, the mast collar 15 is formed with a generally tubular member 18, which preferably contains a longitudinal slit 19, FIGS. 2, 3, and 4. In FIG. 3, arrow 20 indicates the forward direction of the sailboard. The interior of the collar may be fabricated with a plurality of full length internal ridges 21. In the unassembled condition, the inner surfaces 23 of the ridges 21 form an interrupted internal surface that is slightly larger than the outer diameter of the mast 5 unless made of a flexible material. Thus, the mast collar is easily slideable on the mast. The collar further includes a pair of laterally facing bosses 25, FIGS. 2, 3, and 4. The bosses are constructed with flat faces 27 that converge upwardly, as best shown in FIG. 4. Alternatively, the collar can be inverted and thus the bosses would converge downwardly. The boom yoke 17 would also be inverted. The after side of the bosses are bounded by generally arcuate shoulders 29. The forward side of the mast collar contains a fulcrum, such as a horizontal circular slot 31, which may be formed as a semicircular opening in a protrusion 33, FIGS. 2 and 3.

Further in accordance with the present invention, the gooseneck 13 includes a boom yoke 17 that cooperates with the mast collar 15 to rigidly attach the boom to the mast. In the illustrated embodiment, the boom yoke includes a pair of after facing receptacles 35 for receiving the two spars 10. FIG. 3 illustrates the receptacles 35 as diverging sternwardly to accommodate a wishbone shaped boom. Pins 39 may be employed to more or less permanently fasten the spars 10 to the receptacles. The receptacles are joined at their forward ends by a gusset 41, which may include an aperture 43 for receiving a sailing uphaul line 44. The outwardly facing portions of the receptacles may be connected with a C-shaped member 45, thus creating an opening 47 which serves as a convenient hand hold and support for a rubber bumper 52. The member 45 also rigidifies and stiffens the entire yoke 17.

To interlock with the mast collar 15 in a convenient manner, the boom yoke 17 is provided with a rotatable connecting means, such as a circular member 49, that can be constructed as part of the gusset 41. The diameter of the circular member 49 corresponds with the diameter of the circular slot 31 in the mast collar. Also, to interlock the mast collar and boom yoke, the inwardly facing external portions of the boom receptacles 35 are fabricated with flat faces 51, FIGS. 3 and 4. The flat faces cooperate with and converge upwardly at the same angle as the collar flat faces 27, as best seen in FIG. 4. The after side of each flat face 51 terminates in an inwardly extending tab 53. The forward facing surfaces 55 of the tabs 53 may be of generally arcuate shape for at least a portion of their length, FIG. 2.

To assemble the sail 7 and boom 9 to the mast 5 using the gooseneck of the present invention, the sail tack 57 is slipped over the mast as far as the cutout 59. The mast collar 15 is inserted within the cutout 59 and placed over the mast. Then the remainder of the sail is installed. The boom 9 is placed around the mast, and it is tilted upwardly toward the stern, as shown in phantom in FIG. 2. In this attitude, connector 49 of the boom yoke 17 slides into circular slot 31 of the mast collar by moving the boom yoke aft. The slot 31 thus acts as a fulcrum about which the boom 9 can rotate. Downward rotation of the boom causes engagement of tab surfaces 55 with the arcuate shoulders 29 of bosses 25. When the boom is rotated to a generally horizontal attitude, as shown by the solid lines of FIG. 2, the boom yoke is firmly attached to the mast collar in a generally fore-aft direction through the cooperation between the connector 49 and slot 31, and between the tabs 53 and shoulders 29. To prevent the boom from rising above the horizontal attitude while sailing, an outhaul, not illustrated in FIG. 1, is fastened between the sail clew 61 and the after end of the boom.

To complete the assembly of the boom 9 to the mast 5, the mast collar 15 tightly grips the mast when the boom is in the horizontal attitude. This is accomplished through the cooperation of the flat surfaces 27 on the collar and flat surfaces 51 on the boom yoke. As the boom is lowered from the tilted position as explained previously, the flat faces 51 slidingly abut the flat faces 27 to produce a wedging action that circumferentially compresses the tubular member 18 of the collar. As a result, the longitudinal slit 19 is taken up, FIG. 4, and the inner surfaces 23 of internal ridges 21 tightly grip the mast.

To loosen the mast collar for relocating, it is necessary only to lift the after end of the boom until the cooperating flat surfaces 27, 51 disengage sufficiently to loosen the grip between the ridges 21 and the mast. To disassemble the boom from the mast, it is necessary only to lift the boom until the tabs 53 disengage the shoulders 29.

Further advantageous characteristics of the gooseneck of the present invention include high strength, light weight, and element-resistant material. For example, the components of the gooseneck may be made of a molded synthetic material, such as is sold under the trade designation Delrin.

Without further description, it is thought that the advantages to be gained from the disclosed embodiment of my sailboard gooseneck will be apparent to those skilled in the art. It is contemplated that various modifications and changes may be made to the sailboard gooseneck of the present invention within the scope of the appended claims without departing from the spirit of the invention. Although the disclosure has described the faces 27 as converging upwardly, the assembly could be arranged with faces converging downwardly if the matching faces 51 of the yoke were also facing downwardly.

I claim:

1. A gooseneck for rigidly and detachably attaching the boom to the mast of a wind-powered vehicle, comprising:

a. A mast collar including:

i. A generally tubular member;
ii. A pair of bosses extending laterally from the tubular member and having generally arcuate after facing shoulders and upwardly or downwardly convergent flat faces; and
iii. A fulcrum fastened to the outer periphery of the tubular member intermediate the two bosses; and b. A mast yoke including:
i. A pair of stern facing boom receiving receptacles;
ii. Gusset means for joining the forward ends of the boom receptacles;
iii. Connecting means for rotatable engagement with the fulcrum of the mast collar;
iv. A pair of inwardly facing upwardly or downwardly converging flat faces fastened to the inner portions of the boom receiving receptacles and adapted to cooperate with the flat faces of the mast collar; and
v. Tab means extending inwardly from the flat faces and adapted to engage the bosses of the mast collar,
so that inserting the connecting means into the fulcrum and rotating the boom yoke about the mast collar fulcrum engages the tab means with the arcuate shoulders on the bosses and wedges the flat faces of the yoke against the flat faces of the collar to circumferentially compress the tubular member.

2. The gooseneck of claim 1 wherein the fulcrum of the mast collar includes a circular slot, and wherein the connecting means of the boom yoke is a round pin.

3. The gooseneck of claim 1 wherein the connecting means of the boom yoke is formed integrally with the gusset means.

4. The gooseneck of claim 1 wherein the tubular member is longitudinally slit at least part way along the length thereof.

5. The gooseneck of claim 4 wherein the longitudinal slit is formed opposite the fulcrum means.

6. The gooseneck of claim 1 wherein the forward ends of the boom receiving receptacles are further connected by a generally C-shaped member to create a convenient hand hold and stiffening member.

7. The gooseneck of claim 1 wherein the gusset means is formed with an aperture for receiving a sail line.

8. The gooseneck of claim 1 wherein the tab means includes at least partially arcuate forwardly facing surfaces.

9. The gooseneck of claim 1 wherein the boom receiving receptacles are sternwardly divergent.

10. The gooseneck of claim 1 wherein the boom yoke includes pin means for retaining the boom within the boom receiving receptacles.

11. In combination with a wind-powered vehicle having a hull, a boom, a mast, and a sail, a gooseneck for rigidly attaching the boom to the mast in a generally fore-aft orientation, comprising:

a. A mast collar disposed over the mast including:
i. A generally tubular member having a longitudinal slit extending at least partially along the length thereof;
ii. A circular fulcrum formed in the forward facing portion of the tubular member; and
iii. A pair of laterally facing bosses formed with after facing generally arcuate shoulders and upwardly converging flat faces; and b. A boom yoke fastened to the forward end of the boom including:
i. A pair of after facing boom receiving receptacles;
ii. Gusset means for joining the forward ends of the boom receiving receptacles and having connecting means for rotational connection with the fulcrum;
iii. A pair of inwardly facing upwardly converging flat faces formed on the external portions of the boom receiving receptacles and adapted for cooperation with the flat faces on the mast collar; and
iv. Tab means extending inwardly from the stern ends of the flat faces and adapted for engagement with the generally arcuate shoulders of the mast collar bosses,
so that insertion of the connecting means into the fulcrum while the boom is tilted aft and upward and rotation of the boom in a downward direction engages the tab means with the shoulders and wedges the yoke flat faces against the collar flat faces to circumferentially suppress the mast collar into firm locking into the mast.

12. The combination of claim 11 wherein the longitudinal slit is formed in the stern facing portion of the tubular member.

13. The combination of claim 11 wherein the forward ends of the boom receiving receptacles are further joined by a C-shaped member to create a convenient hand hold and stiffening member.

14. The combination of claim 11 wherein the gusset is formed with an aperture for receiving a sail line.

15. The combination of claim 11 wherein the boom receiving receptacles are sternwardly divergent.

* * * * *